US009969094B2

(12) United States Patent
Hejmowski et al.

(10) Patent No.: US 9,969,094 B2
(45) Date of Patent: May 15, 2018

(54) METHOD OF SHAPING A SURFACE COATING ON A RAZOR BLADE USING CENTRIFUGAL FORCE

(71) Applicant: Edgewell Personal Care Brands, LLC., Chesterfield, MO (US)

(72) Inventors: Tomasz Hejmowski, Milford, CT (US); Massimo Nyiry, Milford, CT (US); David Tressel, Bethany, CT (US); Yiming Xu, Milford, CT (US)

(73) Assignee: Edgewell Personal Care Brands, LLC, Chesterfield, MO (US)

( * ) Notice: Subject to any disclaimer, the term of this patent is extended or adjusted under 35 U.S.C. 154(b) by 210 days.

(21) Appl. No.: 14/872,466

(22) Filed: Oct. 1, 2015

(65) Prior Publication Data

US 2016/0096281 A1 Apr. 7, 2016

Related U.S. Application Data

(60) Provisional application No. 62/060,268, filed on Oct. 6, 2014.

(51) Int. Cl.

| | |
|---|---|
| ***B05D 3/12*** | (2006.01) |
| ***B26B 21/60*** | (2006.01) |
| ***B05D 1/00*** | (2006.01) |
| ***B05D 3/02*** | (2006.01) |
| *B05D 5/08* | (2006.01) |

(52) U.S. Cl.

CPC ..... *B26B 21/60* (2013.01); *B05D 1/005* (2013.01); *B05D 3/0254* (2013.01); *B05D 1/002* (2013.01); *B05D 5/083* (2013.01)

(58) Field of Classification Search

CPC ..... B26B 21/60; B05D 1/002; B05D 1/005; B05D 3/0254; B05D 5/083

USPC ..... 427/240, 346

See application file for complete search history.

(56) References Cited

U.S. PATENT DOCUMENTS

| | | | | |
|---|---|---|---|---|
| 3,743,551 A | | 7/1973 | Sanderson et al. | |
| 3,838,512 A | | 10/1974 | Sanderson | |
| 5,532,310 A | * | 7/1996 | Grenfell | C08J 3/09 524/244 |
| 5,985,459 A | * | 11/1999 | Kwiecien | B26B 21/60 30/346.5 |
| 7,247,249 B2 | | 7/2007 | Trankiem | |

(Continued)

FOREIGN PATENT DOCUMENTS

| | | | |
|---|---|---|---|
| WO | 2005084807 | A1 | 9/2005 |
| WO | 201008118 | A1 | 7/2010 |
| WO | 201008119 | A1 | 7/2010 |

OTHER PUBLICATIONS

International Search Report for PCT/US2015/053450, filed on Oct. 1, 2015.

*Primary Examiner* — Kirsten Jolley

(74) *Attorney, Agent, or Firm* — Edgewell Personal Care Brands, LLC

(57) ABSTRACT

A method for shaping a coating on a razor blade is provided. The method includes the steps of: a) providing a razor blade having a tip end defined by at least one tip surface; b) applying a surface coating having a first thickness on at least one tip surface; and c) shaping the applied surface coating on the at least one tip surface to have a second thickness using a centrifuge, which second thickness is less than the first thickness.

20 Claims, 4 Drawing Sheets

(56) References Cited

U.S. PATENT DOCUMENTS

| | | | | |
|---|---|---|---|---|
| 2003/0157241 | A1* | 8/2003 | Hossainy | A61L 31/10 427/2.24 |
| 2004/0047994 | A1* | 3/2004 | Becker | C23C 4/18 427/346 |
| 2004/0048002 | A1 | 3/2004 | Shifflette | |
| 2005/0031782 | A1* | 2/2005 | Foster | B05D 1/002 427/240 |
| 2005/0155460 | A1* | 7/2005 | Trankiem | B05D 3/107 76/104.1 |
| 2010/0178493 | A1* | 7/2010 | Wang | B26B 21/60 428/336 |

* cited by examiner

METHOD OF SHAPING A SURFACE COATING ON A RAZOR BLADE USING CENTRIFUGAL FORCE

BACKGROUND

1. Technical Field

The present disclosure relates to razor blades in general, and to razor blades with surface coatings in particular.

2. Background Information

Razor blades are typically made of a suitable substrate material such as stainless steel, and a cutting edge is formed with a wedge-shaped configuration with an ultimate tip having a radius less than about 100 nm, such as about 20 to 30 nm. Hard coatings such as diamond, amorphous diamond, diamond-like carbon (DLC) material, nitrides, carbides, oxides or ceramics are often used to improve strength, corrosion resistance and shaving ability, maintaining needed strength while permitting thinner edges with lower cutting forces to be used.

It is known from the art, for instance from U.S. Pat. Nos. 3,743,551 and 3,838,512, that the shaving properties of a razor blade can be improved by applying a polymer outer surface coating (e.g., polytetrafluoroethylene—"PTFE"). Typically, polymer coatings of this type are applied to create a relatively thin layer (e.g., equal to or less than 500 nm) on at least the tip of the blade. The layer can be applied using a variety of different techniques; e.g., spray application, bath dipping, etc. Since no application process will apply a perfectly uniform layer thickness across the entire desired surface, the thickness of the initially applied layer is typically chosen to ensure adequate layer thickness given an expected thickness variation. Although this "relatively" thin layer ensures adequate layer thickness, it is not optimum for shaving; e.g., it is too thick. During the first few strokes of use of a new coated blade, a portion of the polymer coating (if left at the initial thickness) will be removed from the tip during the shaving process by the user of the blade. This process of moving the surface coating by the user of the blade via contact is sometimes referred to as "push back" or "peel back" of the coating. After the excess polymer coating is "pushed back" by the user, a much thinner layer of polymer coating (a layer that can be one polymer molecule thick) typically remains on the blade edge throughout the useful life of the blade. Until the initial thickness of the polymer coating is "pushed back", however, the user can experience some amount of discomfort.

U.S. Pat. Nos. 5,985,459 and 7,247,249 disclose treating a razor blade cutting edge having an adherent polyfluorocarbon coating with a solvent to partially remove some of the coating, apparently to potentially avoid the aforesaid discomfort associated with the excessively thick coating. Using a solvent can significantly add to the manufacturing cost, and in some instances add additional manufacturing steps. For example, the '459 Patent discloses that in some instances a post-solvent treatment step can be used to remove any excess solvent.

SUMMARY

According to an aspect of the present disclosure, a method for shaping a coating on a razor blade is provided. The method includes the steps of: a) providing a razor blade having a tip end defined by at least one tip surface; b) applying a surface coating having a first thickness on at least one tip surface; and c) shaping the applied surface coating on the at least one tip surface to have a second thickness using a centrifuge, which second thickness is less than the first thickness.

In an embodiment of the foregoing aspect the method further includes the step of sintering the applied surface coating, including heating the applied surface coating to a temperature at which the applied surface coating is in a plastic state.

In a further embodiment of any embodiment or aspect provided above, the step of shaping the applied surface coating includes centrifuging the razor blade with the applied surface coating in a manner that causes a portion of the applied surface coating to move away from the tip end of the razor blade and leave a residual surface coating layer having the second thickness.

In a further embodiment of any embodiment or aspect provided above, the step of sintering the applied surface coating includes sintering the applied surface coating in an environment of gas that is non-reactive with one or both of a surface coating material or a razor blade material. The gas can include at least one of Nitrogen or Argon.

In a further embodiment of any embodiment or aspect provided above, the step of shaping the applied surface coating includes shaping the applied surface coatings in an environment of gas that is non-reactive with one or both of a surface coating material or a razor blade material. The gas can include at least one of Nitrogen or Argon.

In a further embodiment of any embodiment or aspect provided above, the centrifuge has a central rotational axis, and the razor blade is rotated around the central rotational axis, and the blade is oriented in the centrifuge with its tip end in a direction toward the central rotational axis.

In a further embodiment of any embodiment or aspect provided above, the centrifuge has a central rotational axis, and the razor blade is rotated around the central rotational axis, and the blade is oriented in the centrifuge with its tip end in a direction away from the central rotational axis.

According to another aspect of the present disclosure, a method for shaping a coating on a razor blade is provided. The method includes the steps of: a) providing a plurality of razor blades, each razor blade having a tip end defined by at least one tip surface, and an applied surface coating having a first thickness applied on the at least one tip surface; b) loading the razor blades in a centrifuge with the tip ends of the razor blades disposed within the centrifuge in a common orientation; and c) centrifuging the blades to shape the applied surface coating on the at least one tip surface of each razor blade to have a second thickness, which second thickness is less than the first thickness.

In a further embodiment of any embodiment or aspect provided above, further including the step of sintering the applied surface coating on each of the razor blades, including heating the applied surface coating on each razor blade to a temperature at which the applied surface coating is in a plastic state.

In a further embodiment of any embodiment or aspect provided above, the step of sintering the applied surface coating includes sintering the applied surface coating in an environment of gas that is non-reactive with one or both of a surface coating material or a razor blade material. The non-reactive gas can include at least one of Nitrogen or Argon.

In a further embodiment of any embodiment or aspect provided above, the step of centrifuging the blades includes centrifuging the razor blades in a manner that causes a portion of the applied surface coating on each razor blade to move away from the tip end of that razor blade and leave a residual surface coating layer having the second thickness on that blade.

In a further embodiment of any embodiment or aspect provided above, the residual surface coating layer extends over substantially all the tip surface.

In a further embodiment of any embodiment or aspect provided above, the step of centrifuging the blades includes centrifuging the blades in an environment of gas that is non-reactive with one or both of a surface coating material or a razor blade material. The non-reactive gas can include at least one of Nitrogen or Argon.

In a further embodiment of any embodiment or aspect provided above, the centrifuge has a central rotational axis, and the razor blades are rotated around the central rotational axis, and each razor blade is oriented in the centrifuge with its tip end in a direction toward the central rotational axis.

In a further embodiment of any embodiment or aspect provided above, the centrifuge has a central rotational axis, and the razor blades are rotated around the central rotational axis, and each razor blade is oriented in the centrifuge with its tip end in a direction away from the central rotational axis.

In a further embodiment of any embodiment or aspect provided above, the surface coating comprises a fluoropolymer; e.g., polytetrafluoroethylene.

According to another aspect of the present disclosure, a method for shaping a coating on a razor blade is provided. The method includes the steps of: a) providing a plurality of razor blades, each razor blade having a tip end defined by at least one tip surface, and an applied surface coating having a first thickness applied on the at least one tip surface; b) loading the razor blades in a centrifuge with the tip ends of the razor blades disposed within the centrifuge in same orientation; and c) centrifuging the razor blades in a centrifuge with the tip ends of the razor blades disposed within the centrifuge in a common orientation to shape the applied surface coating on the at least one tip surface of each razor blade to have a second thickness, which second thickness is less than the first thickness.

According to another aspect of the present invention, a razor blade is provided. The razor blade includes a tip end defined by at least one tip surface and a coating. The coating on the at least one tip surface is shaped by any embodiment or aspect of the present methods described above.

These and other objects, features and advantages of the present invention will become apparent in light of the detailed description of the invention provided below, and as illustrated in the accompanying drawings.

DETAILED DESCRIPTION

The present disclosure includes methods, and embodiments thereof, for manufacturing a razor blade with a surface coating, and more specifically to methods for shaping a surface coating disposed on a surface of a razor blade. The term "blade" and "blades" are used hereinafter to describe the present disclosure, and unless specifically stated are not intended to limit the present disclosure to a single blade or a plurality of blades.

Figure 1:
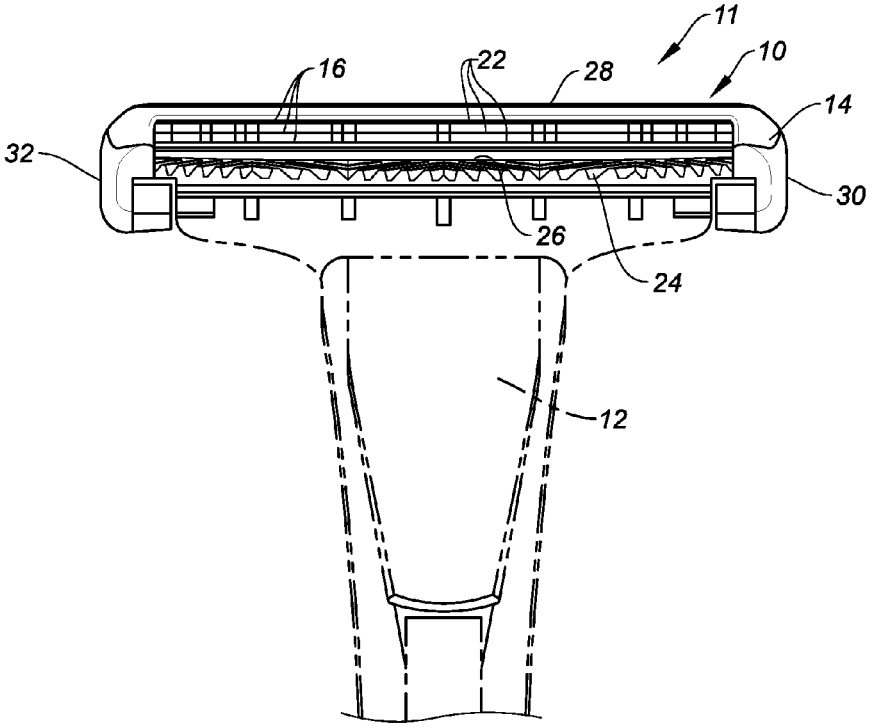
FIG. 1 is a planar front view of a razor assembly including a razor cartridge and a handle.
Figure 2:
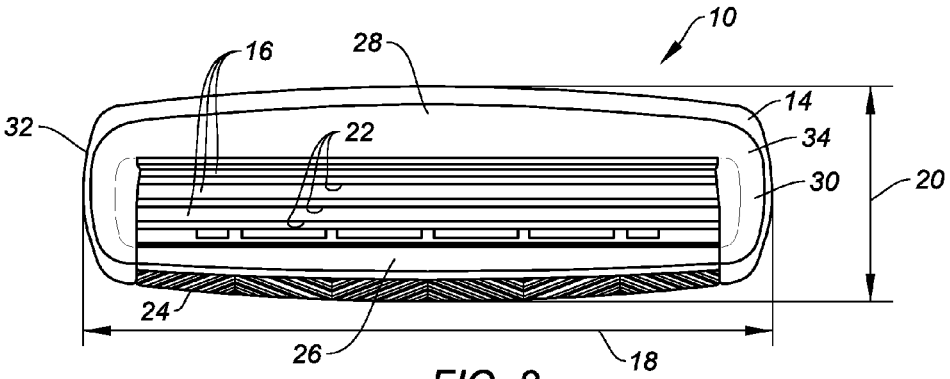
FIG. 2 is a planar top view of the razor cartridge shown in FIG. 1.
Figure 3:
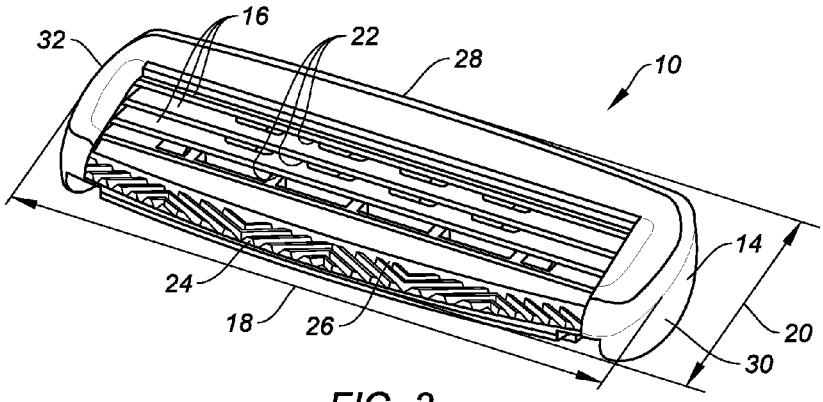
FIG. 3 is a perspective view of a razor cartridge.

Referring to FIGS. 1-3, an exemplary razor cartridge 10 is shown to facilitate the description provided herein. The present disclosure is not limited to this particular razor cartridge embodiment. The razor cartridge 10 pivotally or rigidly mounts on a handle 12 (shown in phantom in FIG. 1). In some applications, the razor cartridge 10 is a disposable portion of a razor assembly 11 intended to be detachable from a reusable handle 12. In other applications, the razor cartridge 10 and a handle 12 are combined into a unitary disposable razor assembly 11. In the latter form, the handle 12 and cartridge 10 are not intended to be detached from one another during normal use.

The razor cartridge 10 includes a body 14, one or more razor blades 16, a length 18, and a width 20. Each of the one or more razor blades 16 has a lengthwise extending cutting edge 22. The present disclosure is not limited to any specific cutting edge configuration, however; e.g., the present disclosure is applicable to linear cutting edges, non-linear cutting edges, cutting edges extending around the perimeter of apertures, etc. The razor cartridge 10 preferably also includes a guard 24. For sake of clarity, the terms "forward" and "aft" as used herein are defined in terms of the orientation in which a blade encounters a user's skin when the blade is used conventionally; e.g., when a razor blade 16 is used in a conventional manner, the blade will move in a direction from forward to aft relative to a point on the user's skin—a forward blade element will encounter the point before an aft blade element. The body 14 includes a forward portion 26, an aft portion 28, a first lateral portion 30, and a second lateral portion 32. The forward portion 26 is disposed between the guard 24 and the one or more razor blades 16. The aft portion 28 (sometimes referred to as the "cap") is disposed aft of the one or more razor blades 16. The first lateral portion 30 and second lateral portion 32 are disposed on opposite lateral sides of the one or more razor blades 16, and both extend between the forward portion 26 and the aft portion 28.

A razor blade 16 according to the present disclosure can assume a variety of configurations, each including a body 34 having a width 36 extending between a tip end 38 and an aft end 40 (which in some embodiments can also be a tip), and a length 42 extending between a first lateral edge 44 and a second lateral edge 46. The body 34 further includes an upper body surface 48 and a lower body surface 50, which body surfaces 48, 50 extend widthwise between the tip end 38 and the aft end 40, and lengthwise between the first and second lateral edges 44, 46. The razor blade description provided herein and shown in the Figures is included to facilitate understanding of the present disclosure. The present disclosure is not limited to this particular razor blade embodiment.

Figure 4:
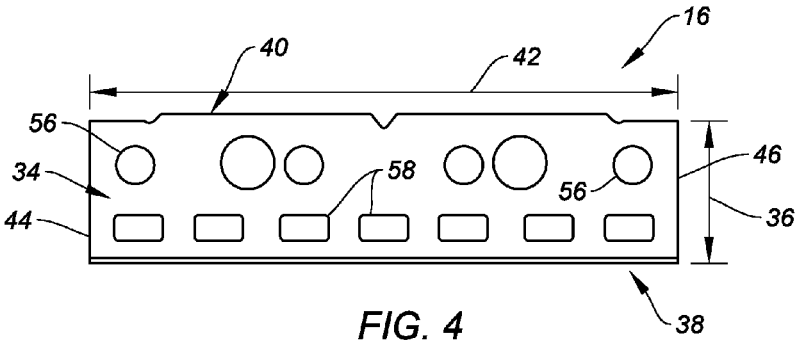
FIG. 4 is a planar top view of an exemplary razor blade that can be used with the present methods.
Figure 5:
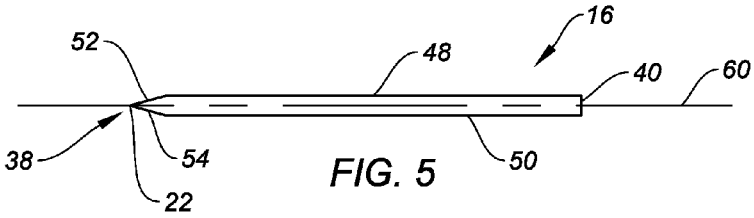
FIG. 5 is a planar side view of an exemplary razor blade that can be used with the present methods.

Referring to FIGS. 4 and 5, the tip end 38 is typically defined by a first tip surface 52, a second tip surface 54, and a cutting edge 22. The first and second tip surfaces 52, 54 converge at the cutting edge 22, each extending aftward to the respective body surface 48, 50 of the razor blade 16. Strictly speaking, in many instances there can be a small radiused surface (sometimes referred to as a "tip radius") at the convergence of the first and second tip surfaces 52, 54. The tip end 38 can alternatively be configured to have a single tip surface extending between the cutting edge 22 and a body surface of the razor blade 16. The present disclosure is not limited to any particular blade tip configuration. Razor blades 16 are often, but not always, manufactured from a stainless steel material, and can as indicated above include a coating comprising one or more materials such as diamonds, amorphous diamonds, diamond-like carbon (DLC) materials, nitrides, carbides, oxides, ceramics, or the like, to improve strength, corrosion resistance and shaving ability. The present method for manufacturing a razor blade 16 with a surface coating, including a method for forming a surface coating adhered to a surface of the razor blade 16, is not limited to practice on any particular razor blade configuration, nor any particular razor blade tip configuration or cutting edge geometry, or blade material.

A surface coating is initially applied to the tip end 38 of a razor blade 16, which initial coating can be referred to hereinafter as an "initial surface coating 62" (e.g., see FIGS. 7*a*, 8*a* and 9*a*). Typically, the initial surface coating 62 is disposed only on one or more tip surfaces of the tip end 38, but can also be applied to additional surfaces of the razor blade 16. Hereinafter, where the surface coating is described as being deposited on the tip end 38, such description should be construed as being applied to at least a tip surface of the tip end 38 and can also be deposited on additional surfaces of the razor blade 16.

The surface coating according to the present disclosure can comprise a variety of different materials. Useful surface coating materials include, but are not limited to, fluoropolymers. A particularly useful fluoropolymeric surface coating material is polytetrafluoroethylene ("PTFE"). Specific examples of fluoropolymers include ZONYL® MP1100, MP1200, MP1600, and KRYTOX® LW1200 brand polytetrafluoroethylene powders manufactured by E.I. DuPont de Nemours and Company, U.S.A., now Chemours Company. Other non-limiting examples of surface coating materials include silicon, organosiloxane gel, etc. The present method is not limited to using any particular type of surface coating material provided the material can be processed in the manner described below. To facilitate the description of the present method, the surface coating material will be discussed as being PTFE. As indicated above, however, the present method is not limited to use with PTFE type surface coating materials.

The present method does not require, and is therefore not limited to, any particular type of process for applying the initial surface coating 62 to a razor blade 16. Examples of application processes that can be used include chemical vapor deposition, laser deposition, sputtering deposition, and nebulization processes. A particularly useful application process is one in which surface coating materials (e.g., PTFE particles) are initially disposed in a dispersion. The dispersion can then be deposited on the tip end 38 in any suitable manner, as for example, by brushing, dipping, or spraying the dispersion onto the tip end 38 to form the initial surface coating 62. The surface coating materials are deposited on the tip end 38 until a layer of the aforesaid materials is formed with a thickness that ensures adequate coverage of the appropriate surface.

According further to the present disclosure, the blades 16 with the applied surface coating are subjected to a thermal sintering process that includes heating the blade 16 and applied surface coating to a predetermined temperature for a period of time adequate for the PTFE particles to fuse together and to adhere to the razor blades 16 and in some instances to drive off some or all of the dispersing media, thereby forming an at least partially sintered form of the aforesaid initial surface coating 62. The applied initial surface coating layer 62 is typically heated to a temperature where the coating is in a plastic state. The term "plastic state" as used herein is used to describe the surface coating material being in a form that is capable of being shaped by centrifugation as described herein and retaining that shape subsequent to the centrifugation. A polymeric surface coating material will typically be in a "plastic state" at a temperature near or above its melting point. As an example, a polymer such as PTFE has a substantially greater stiffness at an ambient temperature than it possesses at an elevated temperature near or above its melting point. During the sintering process, the thickness of the surface coating can decrease from that of the initial surface coating 62.

In some embodiments of the present disclosure, the blades 16 with the applied surface coating can be subjected to the thermal sintering process prior to centrifugation; e.g., the blades 16 can be sintered first, and then subsequently centrifuged as will be described below. In these embodiments, the sintered blades 16 can be transferred to the centrifuging process while the applied surface coatings are in a plastic state, or the applied surface coatings can be reheated to a plastic state prior to centrifuging. In other embodiments of the present disclosure, the blades 16 can be subjected to the thermal sintering process (e.g., heated to a plastic state) initially during centrifugation.

Referring to FIGS. 6-13, according to aspects of the present invention the surface coating applied to a tip end 38 of a razor blade 16 is shaped using centrifugation. As will be explained below, the present shaping process alters the thickness of initial surface coating 62 from an initially applied thickness to a residual applied thickness by subjecting the blade(s) to centrifugal forces that act on the blade 16 and the surface coating applied to the blade 16. The term "thickness" as used herein to describe a dimension of the surface coating layer should not be construed as meaning that the surface coating layer thickness is exactly uniform in the razor blade region described as having that surface coating layer. Rather, the term "thickness" refers to an average thickness in the aforesaid region; e.g., a region described as having a residual surface coating layer 66 of "X" thickness, will have an average thickness of "X" within the region, but can have slight variations in thickness at particular points within the region.

During centrifugation, the blades 16 with the initial surface coating 62 are rotated around a central rotational axis 74 of a centrifuge 76. For the purposes of illustration, in FIG. 6 the blades 16 are depicted with their respective tip ends 38 oriented in a direction parallel to the central rotational axis 74. However the blades 16 can be oriented with their respective tip ends 38 arranged perpendicular to the central rotational axis 74, i.e. in and out of the plane of FIG. 6. Forces oriented in a direction that extends radially outward from the central rotational axis 74 act on the blades 16 and initial surface coatings 62 as a function of rotational speed and radius 72 (see also FIGS. 10-13) from the rotational axis 74 to the tip end 38 of the blade 16. The blades 16 are rotated around the centrifuge rotational axis 74 at a rotational speed (i.e., revolutions per minute around the rotational axis 74) that produces sufficient centrifugal forces to move (or remove) a portion of the initial surface coating 62 away from the tip end 38, leaving a layer of surface coating material (which can be referred to herein as a "residual surface coating layer 66") having a thickness 68 less than the thickness 70 of the initial surface coating 62.

During centrifugation, the blades 16 are typically mounted to or within a structure (e.g., a centrifuge basket 84) and that structure is rotated about the central rotational axis 74 of a centrifuge 76. For example, the centrifuge 76 can include a housing 80, a rotor shaft 82, a basket 84, and a rotor drive 86 operable to rotate the rotor shaft 82. The rotor shaft 82 rotates relative to a static housing 80, and the basket 84 rotates with the rotor shaft 82. The basket 84 can be fixed to the rotor shaft 82, or can be selectively attachable to the rotor shaft 82. The rotor drive 86 is operable to selectively control the rotation of the rotor shaft 82 and attached basket 84; e.g., the rotational speed of the rotor shaft 82 and attached basket 84. The housing typically provides an enclosure for the basket 84.

According to aspects of the present disclosure, the centrifuge 76 includes a heater 88. In those instances where sintering is performed during an initial phase of centrifugation, the heater 88 is operable to heat the blades 16 and initial surface coatings 62 disposed thereon to a temperature where the initial surface coating 62 is in a plastic state. In those instances where the blades 16 are sintered prior to centrifugation, the heater 88 can be used to reheat the blades 16 and initial surface coating 62 to a plastic state. During the subsequent period of time in which centrifugation is used to shape the initial surface coating 62 to leave a residual surface coating layer 66, the heater 88 can be used to maintain the razor blades 16 and initial surface coatings 62 at the same temperature used to establish the plastic state, or a different temperature.

In those embodiments wherein the blades 16 and initial surface coatings 62 are sintered during centrifugation, the blades 16 can be maintained stationary or can be rotated at an initial velocity for an initial period of time sufficient to accomplish the sintering process. The initial velocity can be lower than a velocity used to shape the applied surface coating on the blades 16; e.g., the rotation increases the uniformity of the heating process.

Figure 6:
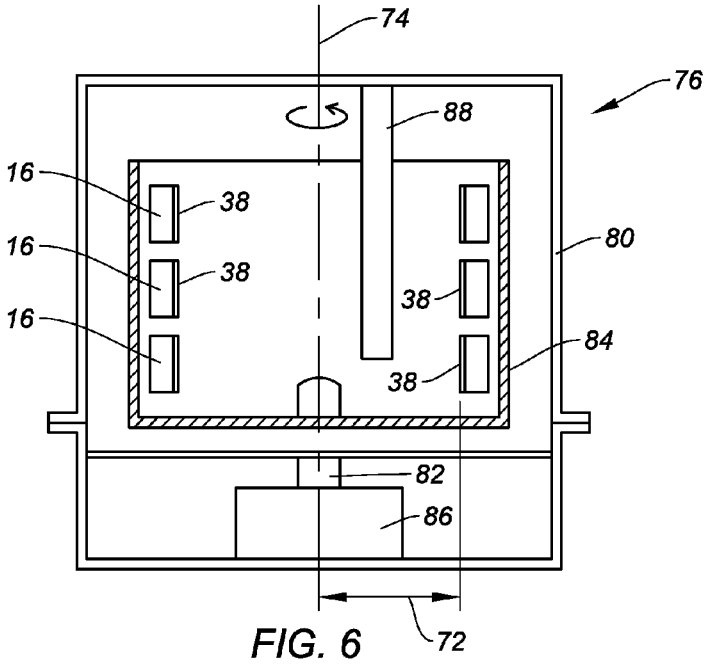
FIG. 6 is a diagrammatic illustration of a centrifuge according to an aspect of the present disclosure.
Figure 9A:
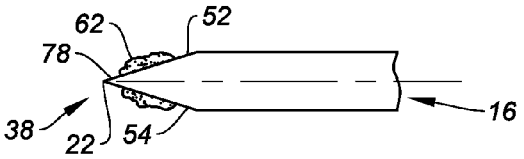
FIG. 9*a* is a diagrammatic illustration of a razor blade tip end with an initial surface coating applied.
Figure 9B:
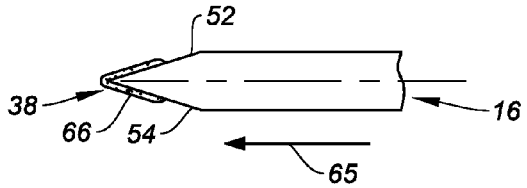
FIG. 9*b* is a diagrammatic illustration of the razor blade tip end shown in FIG. 9*a* after shaping according to the an aspect of the present disclosure.
Figure 10:
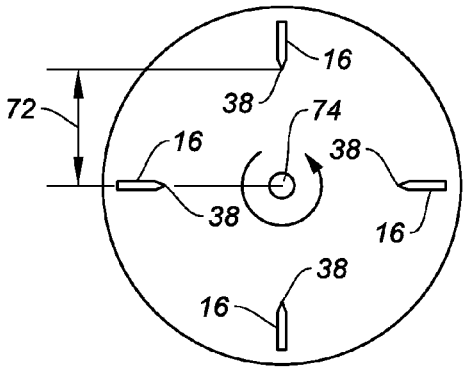
FIG. 10 is a diagrammatic illustration of a plurality of razor blades disposed within a centrifuge with the blade tip ends pointing toward the rotational axis of the centrifuge.
Figure 11:
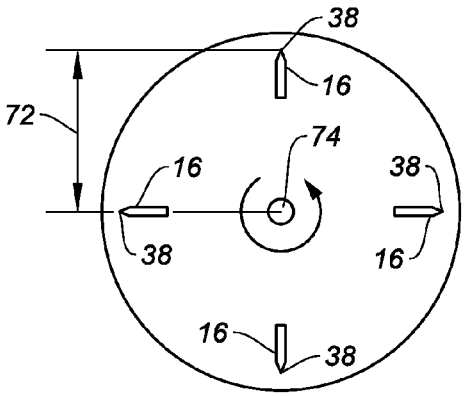
FIG. 11 is a diagrammatic illustration of a plurality of razor blades disposed within a centrifuge with the blade tip ends pointing away from the rotational axis of the centrifuge.
Figure 12:
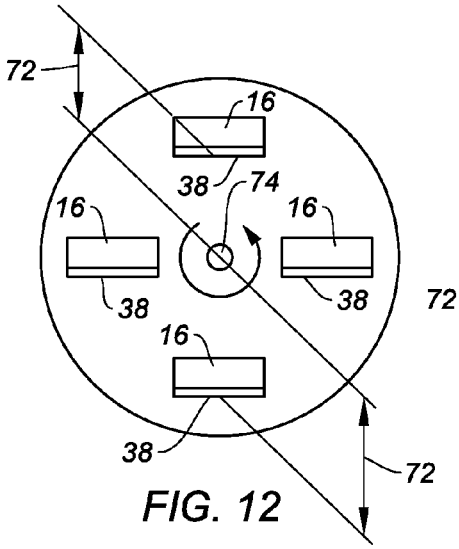
FIG. 12 is a diagrammatic illustration of a plurality of razor blades disposed within a centrifuge.
Figure 13:
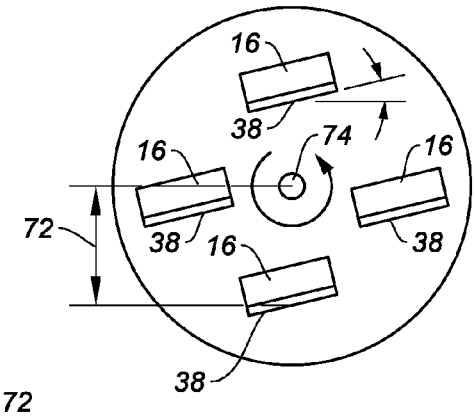
FIG. 13 is a diagrammatic illustration of a plurality of razor blades disposed within a centrifuge.

While the at least partially sintered initial surface coating 62 is in a plastic state, the blades 16 are centrifuged. During centrifugation, blades 16 can be oriented within the centrifuge 76 in a variety of positions relative to the rotational axis 74 of the centrifuge 76 and the present disclosure is not limited to any particular blade orientation within the centrifuge 76. For example, in a first orientation the blades 16 can be oriented so that the tip end 38 of each blade 16 is pointed toward the rotational axis 74 (e.g., see FIGS. 6, 7*a*, 7*b*, and 10). In this orientation, the centrifugal forces acting on the initial surface coating 62 move a portion of the initial surface coating 62 in a direction 63 from the tip end 38 toward the aft end 40 of the blade 16, leaving the residual surface coating layer 66. In an alternative orientation, the blades 16 can be oriented so that the tip end 38 of each blade 16 is pointed away from the rotational axis 74 (e.g., see FIGS. 8*a*, 8*b*, 9*a*, 9*b*, and 11). In this orientation, the centrifugal forces acting on the initial surface coating 62 move a portion of the initial surface coating 62 in a direction 65 toward the tip end 38 of the blade 16, leaving the residual surface coating layer 66; i.e., a direction extending from the aft end 40 toward the tip end 38 of the blade 16. In FIGS. 6 and 10-11 the blades 16 are oriented such that the tip ends extend in a direction generally parallel to the rotational axis 74. FIG. 12 diagrammatically illustrates an orientation where the tip ends 38 are not all disposed toward or away from the central rotational axis 74. FIG. 13 diagrammatically illustrates blades 16 having tip ends 38 disposed at an angle to the central rotational axis 74. In FIGS. 12-13 the blades 16 are oriented such that the bodies 34 of the blades 16 generally perpendicular to the rotational axis 74. In these orientations a rectilinear tip end 38 of a blade 16 will not exhibit a uniform radius 72 along the entirety of the tip end 38. In these orientations, radius 72 can be defined as the distance from the rotational axis 74 to a mid-point of the tip end 38. In these orientations, the present applicants have noted that a change in radius 72 along the tip end 38 is minimal and does not significantly affect the residual surface coating layer 66.

In some embodiments, the blades 16 can be maintained within the centrifuge 76 in an environment of a non-reactive gas. A "non-reactive" gas, as that term is used herein, means that the gas does not cause a change in a material property of the surface coating material (e.g., chemically alter the surface coating material) in a manner that would detrimentally affect the ability of the surface coating material to perform as a surface coating. Preferably, the non-reactive gas also does not cause a change in a material property of the razor blade material (e.g., chemically alter the razor blade material) during centrifugation in a manner that would detrimentally affect the performance or appearance (e.g., surface discoloration) of the razor blade 16. Nitrogen gas ($N_2$) and argon gas (Ar) are non-limiting examples of acceptable environmental gases. In some applications, the environmental gas(es) can include one or more gases that react with oxygen present in the furnace to decrease the potential for oxidation of elements within the furnace.

The blades 16 are spun within the centrifuge 76 at a rotational speed and for a period of time that is adequate to form the desired residual surface coating 66 on the tip end surface(s) of the tip end 38 of each blade 16. The specific rotational speed and time period will likely vary depending upon factors such as the radius of the tip end, the initial surface coating 62 material, thickness, and/or temperature, the desired thickness of the residual surface coating layer 66, etc. Our experience is that centrifugal shaping of the initial surface coating 62 can be accomplished by rotating the blades 16 (with applied surface coating in a plastic state) at a rotational speed in the range of about eight hundred to about four thousand rpms (800-4000 rpms), a radius about 100 to about 225 mm and for a period of time in the range of about one to six minutes (1-6 minutes). The present disclosure is not limited to any particular centrifugation parameters, and the above ranges are provided as non-limiting examples. Examples of specific centrifugation parameters are provided below.

Subsequent to centrifugation, a residual surface coating layer 66 remains on at least a portion of a tip surface of the tip end 38. The residual surface coating layer 66 can have a thickness 68 equivalent to about a monolayer of surface coating material particles. The residual surface coating layer 66 can have a uniform thickness 68, but such a uniform thickness residual surface coating layer 66 is not required. Once the residual surface coating layer 66 is formed, the sintering process can be continued at a predetermined temperature for an additional period of time (e.g., a second heating period that can be at the same temperature or a different temperature than used in the first heating period or as used in the formation period) until the sintering process is completed.

In regards to the specific physical characteristics of the residual surface coating layer 66, the specific thickness of the residual surface coating layer 66 and the distance that the residual surface coating layer 66 (and regions thereof as applicable) extends aft of the cutting edge 22 can be chosen to suit the application at hand; e.g., to create a desired comfort level for the user of the particular razor blade 16 and surface coating. It is our understanding that during the normal useful life of the razor blade 16, the residual surface coating layer 66 will remain adhered to the tip end surfaces 52, 54.

To ensure a fully enabled description of the present disclosure, a specific example of a formation process is provided hereinafter. The present disclosure is not limited to the following example.

In this example, a plurality of razor blades 16 is processed to create a residual surface coating layer 66 on at least one tip surface 52, 54 of the tip end 38 of each blade 16. First, an initial surface coating 62 layer of PTFE (e.g., KRYTOX® LW-1200 by Chemours Company) is applied to the tip end surfaces 52, 54 of the plurality of blades 16 by spraying the tip end surfaces 52, 54 with a dispersion that includes PTFE particles disposed within a dispersing media. The initial surface coating layer 62 is typically applied to a thickness of no more than 500 nm, and preferably applied to a thickness of between 100 nm and 400 nm, and allowed to dry, i.e. such that the dispersing media evaporates.

The initial coating applied blades 16 are subsequently loaded within a centrifuge basket 84. In this example, the blades 16 are loaded into the basket 84 in an orientation wherein the tip end 38 of each blade 16 is pointing toward the central rotational axis 74 of the centrifuge 76 (e.g., see FIGS. 6, 7*a*, 7*b*, and 10) and spaced from the central rotational axis 74 by a radius 177 mm. The basket 84 is subsequently placed within an interior volume of the centrifuge 76. The interior volume of the centrifuge 76 is subsequently filled with a non-reactive gas; e.g., at a positive pressure relative to ambient pressure to maintain the non-reactive gas environment, and prevent entry of air containing oxygen into the internal volume. The present disclosure is not limited to a non-reactive gas at any particular temperature. For example, a $N_2$ gas used to fill the centrifuge internal volume can be at room temperature, or it can be at an elevated temperature. The $N_2$ gas is non-reactive with the surface coating material and the razor blade material.

After the non-reactive gas environment is established, the centrifuge heater 88 is activated to heat the razor blades 16 and initial surface coatings 62 are heated to a temperature in the range of about 300° C. to 450° C. for a period of time sufficient to at least partially melt the PTFE particles within the surface coating dispersion, remove any dispersing media, and fuse at least some of the PTFE particles to each blade tip end 38 in a substantially uniform thickness film. Our findings to date indicate that maintaining the blades 16 with the initial surface coating 62 at a temperature in the above identified range for a period of time in the range of about thirty seconds to about three minutes (30 seconds to 3 minutes) is adequate to at least partially sinter the initial surface coatings 62. During the initial sintering, the centrifuge basket 84 and the blades 16 loaded therein are maintained in a stationary position.

Once the initial surface coatings 62 are adequately initially sintered, the basket 84 and the loaded blades 16 are subjected to centrifugation; e.g., rotated to a speed of about 3400 rpms for a period of time in the range of about four to six minutes (4-6 minutes). During centrifugation, the temperature is maintained within the aforesaid range (e.g., 300-450° C.). As indicated above, the temperature, rotational speed, and time periods identified within this example are values chosen to illustrate an example of the present method, and the present disclosure is not limited to these values.

Figure 7A:
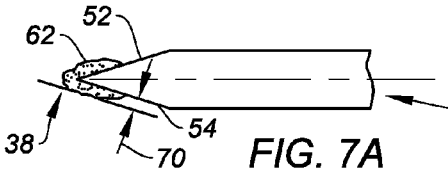
FIG. 7*a* is a diagrammatic illustration of a razor blade tip end with an initial surface coating applied.
Figure 7B:
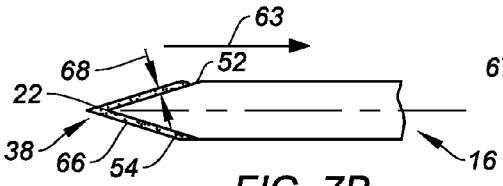
FIG. 7*b* is a diagrammatic illustration of the razor blade tip end shown in FIG. 7*a* after shaping according to the an aspect of the present disclosure.

During centrifugation, a portion of the sintered applied initial surface coating 62 is forced away from the tip end 38 by centrifugal forces acting on the coating, in a direction 63 that is at least in part toward the aft end of the blade 16 (e.g., see FIGS. 7*a* and 7*b*). After the portion of the initial surface coating 62 is forced away from the blade tip end 38, a residual surface coating layer 66 remains, bonded to the tip surface(s) to which it was initially applied. The removed initial coating material can migrate aft ward and be bonded to the blade 16, or can separate from the blade 16 to which it was initially attached. Subsequent to the centrifugation, the blades 16 can be subjected to a second sintering process to complete the sintering of the remaining residual surface coating layer 66.

In a second example, a plurality of razor blades 16 is processed to create a residual surface coating layer 66 on at least one tip surface of the tip end 38 of each blade 16. The surface coating material is the same as that used in the first example; e.g., PTFE (e.g., KRYTOX® LW-1200 by Chemours Company), and is applied to the tip end surfaces 52, 54 of the plurality of blades 16 in the same manner.

The initial surface coating applied blades 16 are subsequently loaded within a centrifuge basket 84. In this example, the blades 16 are loaded into the basket 84 in an orientation wherein the tip end 38 of each blade 16 is pointing away from the central rotational axis 74 of the centrifuge 76 (e.g., see FIGS. 8*a*, 8*b*, 9*a*, 9*b*, and 11) and spaced from the central rotational axis 74 by a radius 184 mm. The introduction of a non-reactive gas (e.g., $N_2$) into the interior volume of the centrifuge 76 and the initial sintering process are the same as the first example.

Once the initial surface coatings 62 are adequately initially sintered, the basket 84 and the loaded blades 16 are subjected to centrifugation using the same parameters as the first example.

Figure 8A:
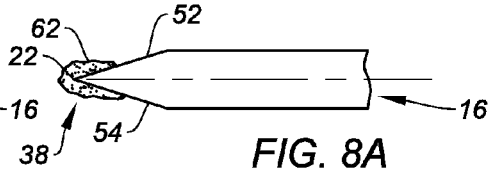
FIG. 8*a* is a diagrammatic illustration of a razor blade tip end with an initial surface coating applied.
Figure 8B:
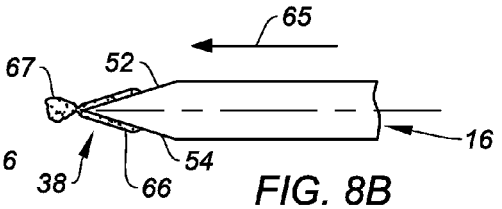
FIG. 8*b* is a diagrammatic illustration of the razor blade tip end shown in FIG. 8*a* after shaping according to the an aspect of the present disclosure.

During centrifugation, a portion of the sintered initial surface coating 62 is forced toward the tip end 38 by centrifugal forces acting on the coating (e.g., see FIGS. 8*a* and 8*b*). During centrifugation, a portion of the initial surface coating 62 collects at the tip end 38 (e.g., as a droplet 67, or periodic droplets) and is flung from the blade 16. After the portion of the initial surface coating 62 is forced away from the blade tip end 38, a residual surface coating layer 66 remains bonded to the tip surface(s) to which it was initially applied. Subsequent to the centrifugation, the blades 16 can be subjected to a second sintering process to complete the sintering of the remaining residual surface coating layer 66.

Orienting the blades 16 with the blade tips 38 pointing away from the central rotational axis 74 can facilitate providing a more uniform residual surface coating layer 66. Referring to FIGS. 9*a* and 9*b*, a blade tip is shown having a pair of tip surfaces 52, 54. If the application of the initial surface coating 62 is not uniform, it is possible that one or more surface coating voids 78 can be formed; e.g., FIG. 9*a* shows a coating void 78 disposed at the convergence of the first and second tip surfaces 52, 54 (e.g., cutting edge 22). In such an instance, the migration of the surface coating material toward the tip end 38 can fill such voids and ultimately produce a more uniform residual surface coating layer (e.g., see FIG. 9*b*).

Although this invention has been shown and described with respect to the detailed embodiments thereof, it will be understood by those skilled in the art that various changes in form and detail thereof can be made without departing from the spirit and the scope of the invention.

What is claimed is:

1. A method for shaping a coating on a razor blade, comprising the steps of:

providing a razor blade having a tip end defined by at least one tip surface;

applying a surface coating having a first thickness on at least one tip surface; and shaping the applied surface coating on the at least one tip surface to have a second thickness using a centrifuge, which second thickness is less than the first thickness; and sintering the applied surface coating, including heating the applied surface coating to a temperature at which the applied surface coating is in a plastic state;

wherein the step of shaping the applied surface coating includes centrifuging the razor blade with the applied surface coating in a manner that causes a portion of the applied surface coating to move away from the tip end of the razor blade and thereby leaving a residual surface coating layer having the second thickness; and wherein the step of shaping the applied surface coating further includes shaping the applied surface coatings in an inert environment comprising a non-reactive gas.

2. The method of claim 1, wherein the step of sintering the applied surface coating includes sintering the applied surface coating in an environment of gas that is non-reactive with one or both of a surface coating material or a razor blade material.

3. The method of claim 2, wherein the gas comprises at least one of Nitrogen and Argon.

4. The method of claim 1, wherein the gas comprises at least one of Nitrogen and Argon.

5. The method of claim 1, wherein the residual surface coating layer extends over substantially all the tip surface.

6. The method of claim 1 wherein the centrifuge has a central rotational axis, and the razor blade is rotated around the central rotational axis, and the blade is oriented in the centrifuge with its tip end in a direction toward the central rotational axis.

7. The method of claim 1 wherein the centrifuge has a central rotational axis, and the razor blade is rotated around the central rotational axis, and the blade is oriented in the centrifuge with its tip end in a direction away from the central rotational axis.

8. The method of claim 1, wherein the surface coating comprises a fluoropolymer.

9. The method of claim 8, wherein the surface coating comprises polytetrafluoroethylene.

10. A method for shaping a coating on a razor blade, comprising the steps of:

providing a plurality of razor blades, each razor blade having a tip end defined by at least one tip surface, and an applied surface coating having a first thickness applied on the at least one tip surface;

loading the razor blades in a centrifuge with the tip ends of the razor blades disposed within the centrifuge in a common orientation; and centrifuging the blades to shape the applied surface coating on the at least one tip surface of each razor blade to have a second thickness, which second thickness is less than the first thickness;

wherein the step of centrifuging the blades includes centrifuging the blades in an environment of a non-reactive gas.

11. The method of claim 10, further comprising the step of sintering the applied surface coating on each of the razor blades, including heating the applied surface coating on each razor blade to a temperature at which the applied surface coating is in a plastic state.

12. The method of claim 11, wherein the step of sintering the applied surface coating includes sintering the applied surface coating in an environment of gas that is non-reactive with one or both of a surface coating material or a razor blade material.

13. The method of claim 12, wherein the gas comprises at least one of Nitrogen and Argon.

14. The method of claim 10, wherein the step of centrifuging the blades includes centrifuging the razor blades in a manner that causes a portion of the applied surface coating on each razor blade to move away from the tip end of that razor blade and leave a residual surface coating layer having the second thickness on that blade.

15. The method of claim 10, wherein the residual surface coating layer extends over substantially all the tip surface.

16. The method of claim 10, wherein the gas comprises at least one of Nitrogen and Argon.

17. The method of claim 10 wherein the centrifuge has a central rotational axis, and the razor blades are rotated around the central rotational axis, and each razor blade is oriented in the centrifuge with its tip end in a direction toward the central rotational axis.

18. The method of claim 10 wherein the centrifuge has a central rotational axis, and the razor blades are rotated around the central rotational axis, and each razor blade is oriented in the centrifuge with its tip end in a direction away from the central rotational axis.

19. The method of claim 10, wherein the surface coating comprises a fluoropolymer.

20. The method of claim 19, wherein the surface coating comprises polytetrafluoroethylene.

* * * * *